US005401191A

United States Patent [19]

Krage, Jr. et al.

[11] Patent Number: 5,401,191

[45] Date of Patent: Mar. 28, 1995

[54] BASE FOR A THREE-WAY LAMP

[75] Inventors: Harvey W. Krage, Jr., Chardon; John R. Agoston, Seven Hills; Ronald E. Maier, Hudson, all of Ohio; Ronald DeCubellis, Providence, R.I.; David W. Allen, No. Scituate, R.I.; James L. Lannan, Foster, R.I.; Glenn H. Kuenzler, Willoughby, Ohio

[73] Assignee: General Electric Company, Schenectady, N.Y.

[21] Appl. No.: 119,853

[22] Filed: Sep. 13, 1993

Related U.S. Application Data

[63] Continuation-in-part of Ser. No. 44,841, Apr. 8, 1993, abandoned.

[51] Int. Cl.[6] ..... H01R 17/00

[52] U.S. Cl. ..... 439/614; 439/615

[58] Field of Search ..... 439/611, 612, 613, 614, 439/615, 616, 617, 619, 662, 734, 642

[56] References Cited

U.S. PATENT DOCUMENTS

| | | | |
|---|---|---|---|
| 2,157,051 | 5/1939 | Birdseye | 439/615 |
| 2,300,870 | 11/1942 | Carlson | 439/615 |
| 2,325,817 | 8/1943 | Watrous, Jr. | 439/617 |
| 2,336,529 | 12/1943 | Cartun | 439/615 |
| 2,336,556 | 12/1943 | Malloy | 439/734 |
| 2,403,137 | 7/1946 | Strickland | 439/615 |
| 2,519,328 | 8/1950 | Whitmore et al. | 439/614 |
| 2,732,532 | 1/1956 | Tamis | 439/615 |
| 2,736,873 | 2/1956 | Bechard et al. | 439/615 |
| 2,999,220 | 9/1961 | Werner | 439/662 |
| 3,131,986 | 5/1964 | Edwards | 439/614 |
| 3,573,534 | 4/1971 | Leighton | 439/615 |
| 3,897,124 | 7/1975 | Pagnotta et al. | 439/734 |
| 4,450,510 | 5/1984 | Nilssen | 439/641 |
| 4,556,822 | 12/1985 | Lohrey et al. | 315/67 |
| 4,605,877 | 8/1986 | Cho et al. | 313/272 |

FOREIGN PATENT DOCUMENTS 444958 4/1936 United Kingdom .

*Primary Examiner*—Larry I. Schwartz
*Assistant Examiner*—Hien D. Vu
*Attorney, Agent, or Firm*—George E. Hawranko; Stanley C. Corwin

[57] ABSTRACT

A modified lamp includes first and second filaments contained in an envelope to which power is selectively provided individually or conjunctively to obtain three distinct light levels. A contact member in the lamp base is modified to include a planar surface over a major portion of its radial width. Additionally, a lead wire opening that receives one of the lead wires extending from one of the filaments, is spaced from the planar surface to limit the potential for electrical contact with a tang of an associated socket. In one preferred embodiment, the lead wire opening is disposed in a recess that has a maximum circumferential dimension less than the cross-section of the tang to preclude advancement of the tang into the recess. A flat is provided along the outer periphery of the contact member to provide accurate orientation of the contact member during lamp assembly.

10 Claims, 3 Drawing Sheets

Fig. 1
(PRIOR ART)
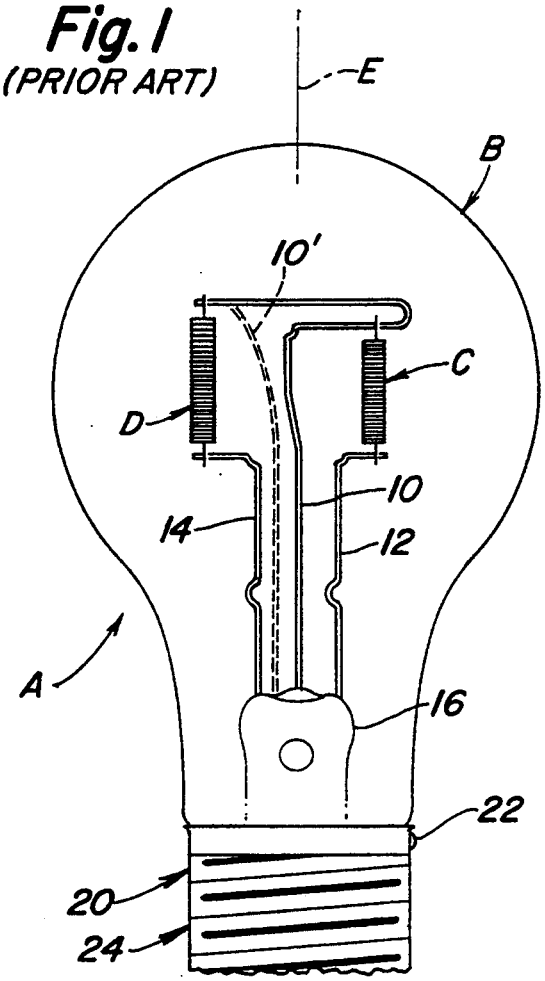
Fig. 2
(PRIOR ART)
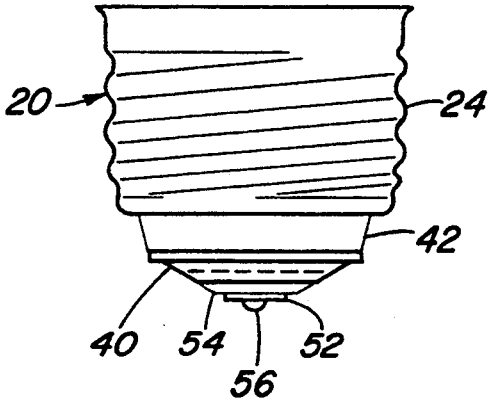
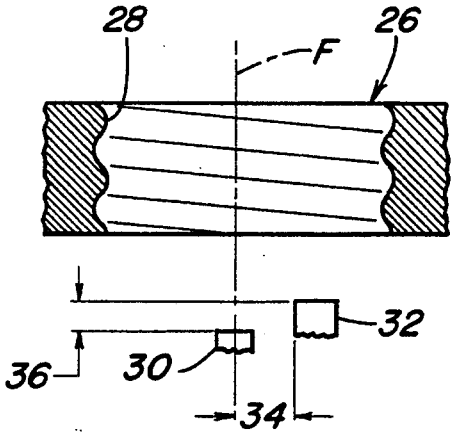
Fig. 3
(PRIOR ART)
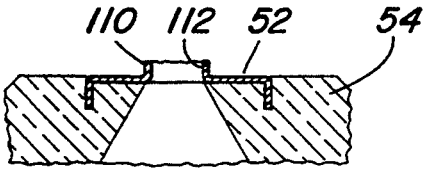
Fig. 8

Fig. 4
(PRIOR ART)
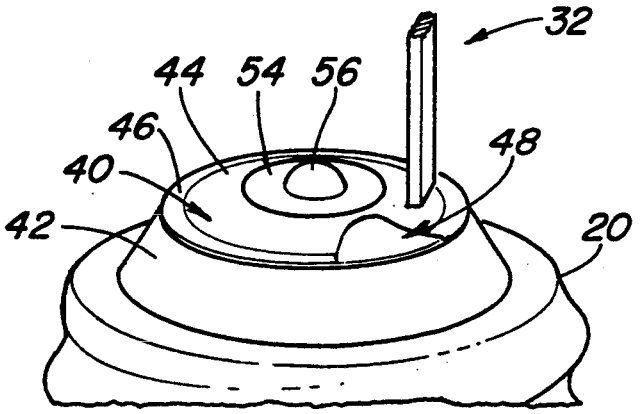
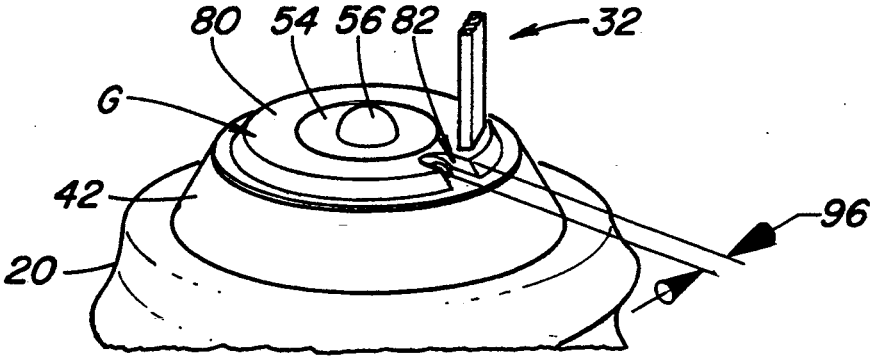
Fig. 5

BASE FOR A THREE-WAY LAMP

This application is a continuation-in-part of Ser. No. 08/044,841, filed Apr. 8, 1993, now abandoned.

BACKGROUND OF THE INVENTION

This invention pertains to the art of electric lamps, and more particularly to incandescent lamps. The invention is applicable to three-way incandescent lamps and will be described with particular reference thereto. However, it will be appreciated that the invention has broader applications in other lamp environments and applications.

Three-way lamps are well known in the industry, the general characteristics of which are described in detail in commonly assigned U.S. Pat. Nos. 3,131,986; 4,556,822; and, 4,605,877. Three-way lamps have a first or minor filament and a second or major filament so that three distinct light levels can be obtained by selectively providing current to the filaments individually or conjunctively.

FIGS. 1–4 of the attached drawings illustrate a prior art three-way lamp and associated lamp socket. These FIGURES are generally intended to illustrate some of the problems associated with known three-way lamp arrangements. Briefly, and with reference to FIGS. 1–4, a conventional three-way lamp A has an envelope or bulb B formed of a light transmissive material such as glass. Enclosed within the envelope are a first or minor filament C and a second or major filament D. Although the filaments are shown in generally parallel relation to one another, and generally parallel to a longitudinal axis E of the lamp, it will be recognized that other orientations of the filaments can be used with equal success. For example, one filament may be disposed in a horizontal direction and the other filament in a vertical direction.

The filaments are connected to a power source (not shown) by first, second, and third lead wires 10, 12, 14, respectively. Of course it will be recognized that the use of four lead wires as represented in phantom by a fourth lead wire 10' can be used as an alternative to the three lead wire arrangement shown in solid lines. The first lead wire is common to both filaments and extends through a glass stem 16 for connection with a generally cylindrical, electrically conductive metal shell or base 20. Usually the connection of the first lead wire to the shell is provided at a fuse area 22 adjacent the envelope and located at a first end of the shell so that the connection will not interfere with an externally threaded portion 24 of the shell. If a four lead wire configuration is used, the first lead wire 10 is only connected to the first filament C and the fourth lead wire 10' is connected to the second filament D. Both the first and fourth lead wires are then secured to the shell as described above.

As is known, the threaded portion of the shell permits the lamp to be screwed into an associated socket 26 (FIG. 3). The socket includes an internally threaded portion 28 that matingly receives the threaded shell therein. Additionally, the socket has a center contact or eyelet contact 30 and an intermediate contact or tang 32. The center contact 30 is spring loaded in the socket and centrally aligned along a longitudinal axis F that coincides with the longitudinal axis of the lamp when received in the socket. The tang 32 is offset or radially spaced from the axis F as is represented by numeral 34. The tang is also offset in an axial direction as represented by numeral 36 for reasons which will be described in greater detail below.

The second lead wire 12 is connected at one end to the minor filament C. It extends through the glass stem and is connected at its other end to a generally annular or ring-shaped contact member 40 (FIGS. 2 AND 4). The contact member 40 is axially spaced and electrically insulated from the shell 20 by an insulating material 42. An opening (not shown) is provided through the insulating material 42 to allow the second lead wire to extend therethrough for connection with the contact member 40. A dome-like or angled surface 44 extends radially inward from a peripheral rim 46 of the contact member. According to the prior arrangement, the angled surface 44 is pierced to form an opening that receives the second lead wire. Solder 48 is then placed over the end of the lead wire to electrically and mechanically connect the second lead wire to the contact member 40.

Further, the third lead wire 14 extends from a second end of the major filament D, through the glass stem 16 for connection with an eyelet 52 (FIG. 2). The eyelet is axially spaced from the contact member 40 by an insulating material 54. A central opening in the eyelet receives the third lead wire therethrough and the terminal end of the lead wire is then mechanically and electrically connected to the eyelet by solder 56.

Although commercially successful, problems have been experienced with this prior art arrangement. For example, as the lamp is threaded into the associated socket 26, the fixed tang 32 can plow into the solder 48 if an excess amount of solder remains on the angled surface 44 as represented in FIG. 4. As the tang plows into the solder, it inhibits proper and full threading of the lamp into the associated socket. Because of the resistance developed from this plowing action, a consumer believes that full threaded advancement of the lamp into the associated socket has occurred. On the contrary, the desired force of contact between the tang 32 and the contact member 40, as well as between the center contact 30 and the eyelet 54, is not achieved.

Moreover, since the desired electrical contact between the tang and the contact member is not achieved, an arc can develop between the tang and the solder. Since lead solder easily oxidizes, an oxidation layer is formed from the heat due to the undesirable arcing. The oxidation layer limits and inhibits electrical flow or contact. This arrangement is unacceptable for the high in-rush current required by the incandescent lamp. Therefore, electrical connection between the contact member 40 and the tang 32 is desired, instead of establishing electrical contact between the tang and the solder.

Thus, it has been desirable to provide a contact member that provides for consistent metal-to-metal contact between the tang and the contact member, avoids the plowing problem associated with excess solder in the prior lead wire connection arrangement, and addresses still other concerns. For example, the lead wire opening in the prior art arrangement is formed during assembly of the lamp base. That is, the contact member is pierced along the angled surface through use of a tapered pin (not shown). Occasionally this piercing operation develops a rough edge that (i) may not be sufficiently bent back away from the opening, (ii) may be misshapen and compressed back through the opening, or (iii) the portion of the insulating glass that usually covers the pierced edge has been removed. Any one of these problems could potentially hinder proper threading of the second lead wire through its formed opening.

One proposed solution to selected ones of the problems identified above has been suggested by U.S. Pat. No. 2,999,220. That patent discloses a three-way lamp base in which the annular contact member provides a series of outwardly projecting bosses. A lead wire aperture is surrounded by an inward, dome-shaped recess. In an alternate embodiment, a C-shaped embossment is provided on the contact member. According to the arrangements disclosed in the '220 patent, the contact member configuration is intended to reduce the exposed height of the lead wire connection in an effort to establish electrical contact with the intermediate tang.

Therefore, while in some respects the '220 patent would appear to suggest a solution to some of the problems discussed above, it is still deemed deficient in many respects. For example, it does not completely address the desired electrical connection between the contact member and the intermediate tang of the associated socket. That is, radial location of the tang has been known to vary, and in fact is recognized under American National Standards Institute (ANSI) as having variable locations. Accepted variation in dimension 34 of the tang can range from 0.205 to 0.260 inches. The narrow C-shaped embossment or one or more projecting bosses as disclosed in the '220 patent would not assure contact between the tang and the contact member when faced with varied location of the tang.

Moreover, the '220 patent does not assure that the tang electrically contacts the contact member. That is, the electrical connection may be established between the solder associated with the lead wire connection and the tang if the final location of the lamp positions the tang over the lead wire recess in the contact member.

These and other desirable features are not adequately addressed by the prior art.

SUMMARY OF THE INVENTION

The present invention contemplates a new and improved lamp that overcomes all of the above-referenced problems and others and provides a simple, economical structure that establishes sound electrical connection between the lamp and socket.

According to one aspect of the invention, an envelope encloses first and second filaments which are connected by at least three lead wires to a shell, contact member, and eyelet to selectively provide three levels of illumination. The contact member has a substantially planar surface over a major portion of its radial width to promote electrical contact with a tang of an associated socket.

According to another aspect of the invention, the contact member has a lead wire opening that is axially spaced from the substantially planar surface to inhibit contact with the tang.

According to yet another aspect of the invention, the recess for the lead wire opening has a circumferential dimension less than a contact surface of the tang of an associated socket to prevent the tang from extending into the recess.

According to still another aspect of the invention, a location surface is provided on the contact member for orienting the contact member during manufacture of the lamp.

A principal advantage of the invention is the ability to achieve good electrical connection between the contact member and tang, and the eyelet and center contact of an associated socket.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein:

FIG. 1 is an elevational view of a portion of a conventional three-way lamp;

FIG. 2 is an enlarged elevational view of a base of a conventional three-way lamp;

FIG. 3 is a cross-sectional view of an associated socket adapted to receive a lamp;

FIG. 4 is a perspective view of a conventional three-way lamp base shown in its relationship with a tang;

FIG. 5 is a perspective view of the subject new lamp base showing its relationship with the tang;

FIG. 8 is an enlarged cross-sectional view of an eyelet formed in accordance with the subject invention.

DETAILED DESCRIPTION OF THE PREFERRED EMBODIMENTS

Figure 6A:
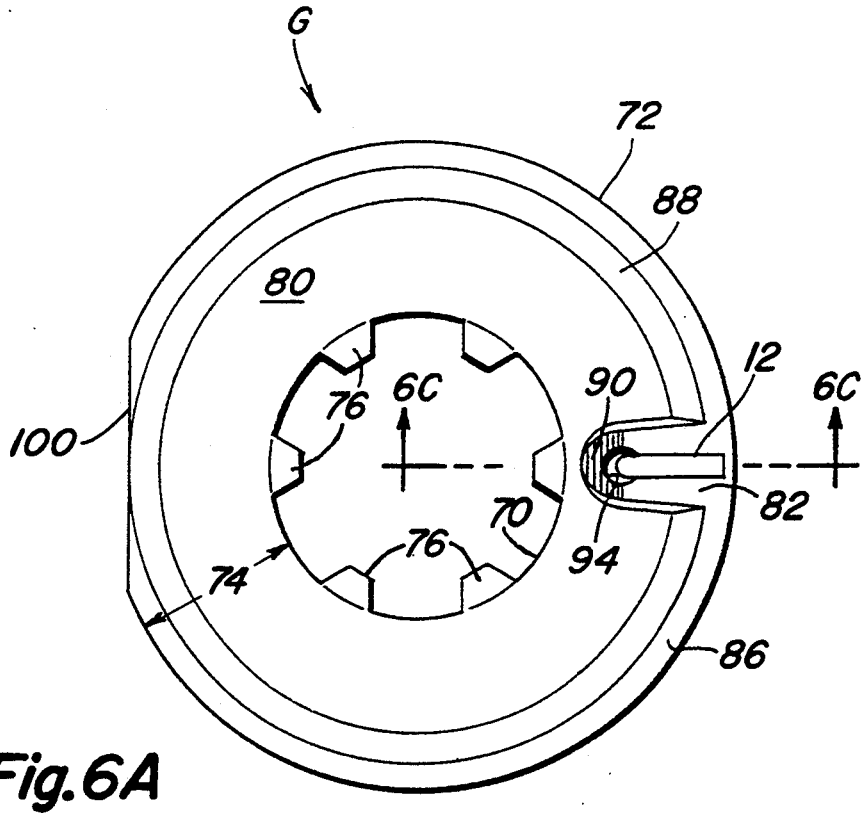
FIG. 6A is a plan view of a contact member formed in accordance with the subject invention.

Referring now to the drawings wherein the showings are for the purposes of illustrating the preferred embodiments of the invention only, and not for purposes of limiting same, FIGS. 5 and 6A–6C show a modified contact member G associated with a three-way lamp as generally described with respect to the prior art configuration of FIGS. 1–4. For purposes of the following discussion, like numerals will refer to like elements while new numerals will refer to new elements of the lamp.

As discussed in the background portion above, prior arrangements (FIG. 4) employing a solder connection between the second lead wire and the conventional contact member 40 could be subject to problems associated with plowing and incomplete advancement of the lamp base into an associated socket because of excess solder.

Figure 6B:
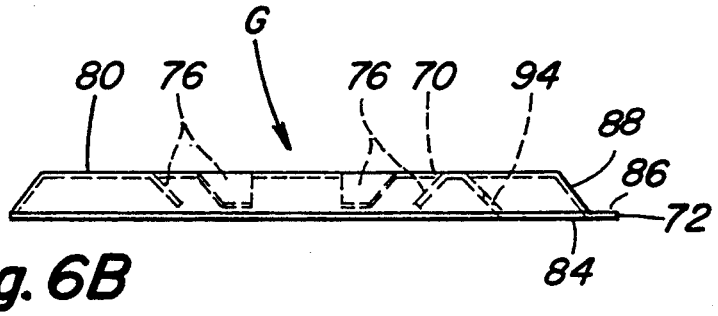
FIG. 6B is a side elevational view of the contact member of FIG. 6A.
Figure 6C:
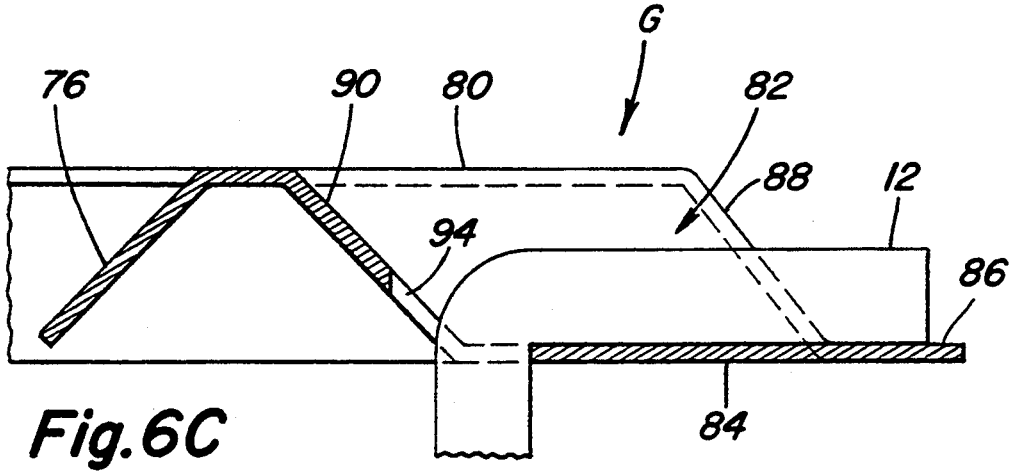
FIG. 6C is an enlarged cross-sectional view taken generally along the lines 6C–6C of FIG. 6A.
Figure 7A:
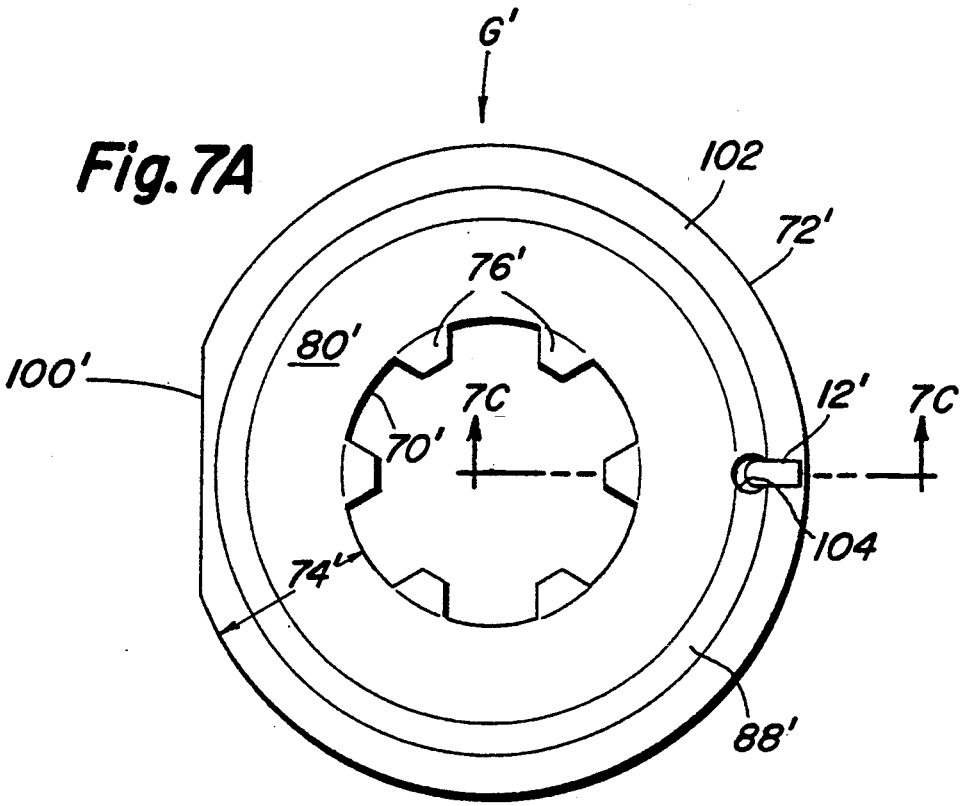
FIG. 7A is a plan view of another preferred embodiment of a contact member.

The modified contact member G shown in FIGS. 5 and 6A through 6C overcomes these and other problems. More particularly, the contact member has an inner periphery 70 and an outer periphery 72 that define an overall radial width as represented by numeral 74 (FIG. 7A). As established by the American National Standards Institute (ANSI), the maximum outer diameter of the contact member can range between 0.610 and 0.760 inches. Similarly, the inner peripheral diameter can range between 0.330 and 0.410 inches. Thus, the radial width can vary from a minimum of 0.100 inches ((0.610–0.410)/2) to 0.215 inches ((0.760–0.330)/2) in accordance with ANSI standards.

With these standards in mind, the subject invention preferably has an outer peripheral diameter 72 of 0.752 inches, an inner peripheral diameter 70 of 0.360 inches, and a preferred radial width 74 of approximately 0.196 inches (0.392/2). Of course, these dimensions may vary somewhat as permitted by allowable tolerances, but demonstrate preferred ranges for purposes of discussion. As will become more apparent below, these dimensions are intended to maximize the area of potential electrical contact between the contact member and the intermediate tang.

A series of circumferentially spaced tabs 76 are provided along the inner periphery of the contact member for receipt within the insulating material 42. The tabs anchor the contact member to the insulating material in a manner well known in the art.

A major portion of the contact member is comprised of a planar surface 80 that defines the contact area. As best illustrated in FIGS. 5 and 6A, this planar surface is circumferentially continuous and of substantially constant radial width. Preferably, the inner diameter of the planar surface is the same dimension as, and defined by, the inner periphery of the contact member. Moreover, the outer extent of the planar surface has a diameter of approximately 0.620 inches to define a radial width on the order of 0.129 inches, which is approximately 66% (0.129/0.196) of the overall radial width of the contact member.

A recess or well 82 interrupts a portion of the planar surface. As best shown in FIGS. 6B and 6C, the base 84 of the recess is axially spaced approximately 0.038 inches below the planar surface Moreover, the bottom surface is coplanar with an outer rim 86 that extends substantially around the contact member. The rim and angled wall 88, that interconnects the rim and planar surface, add strength and rigidity to the contact member.

An angled wall 90 is defined along the radially inner portion of the recess from the base 84 to planar surface 80. The angled wall 90 and base 84 of the recess include a lead wire opening 94 that receives the second lead wire 12 therethrough. According to the preferred arrangement, the lead wire opening 94 is partially formed in the angled wall 90 and partially in the bottom surface 84 of the recess to permit the lead wire to be bent over as shown in FIG. 6C without extending axially beyond the planar surface. Moreover, the lead wire opening is formed in the contact member prior to lamp assembly so that its dimension and configuration can be carefully controlled, for example, eliminating problems associated with the prior art pierced arrangement.

As best illustrated in FIGS. 5 and 6A, the well has a maximum circumferential dimension sufficiently less than the contact surface of the tang 32. This dimension is represented by numeral 96 in FIG. 5. This assures that contact between the tang and the contact member G will always occur along the planar surface 80 since the limited circumferential dimension 96 precludes axial advancement of the end of the tang into the recess 82.

A portion of the outer rim 86 is eliminated through formation of a flat 100 in the outer periphery 72 of the contact member (FIG. 6A). The flat defines a means for orienting the contact member during assembly of the lamp base. Moveover, the flat is used to orient a lamp base during assembly of the lamp which, in turn, accurately locates the position of the lead wire opening 94. Since automated machinery is used to assemble the lamp, a quick and accurate orientation of the contact member is desired in order to increase production rates and the flat accomplishes this objective in a simple and economical manner. Still other configurations of an orienting means can be used within the scope and intent of the subject invention.

With particular reference to FIG. 6C, it is apparent that the second lead wire 12 is fed through the opening 94 and then bent over onto the surface 84 of the contact member. The lead wire is cut so that its outer terminal end does not extend beyond the outer periphery 72 of the contact member. Preferably the second lead wire is soldered or welded to the contact member. Since the contact member is coated with a flux prior to the soldering operation, any excess solder will have a greater affinity for the metal of the contact member as opposed to the insulation 42. Therefore, any excess solder placed in the well to secure the lead wire to the contact member will be retained in the well or along the outer rim 86 adjacent the well without extending to or beyond the planar surface 80. Again, this assures that contact between the tang 32 and the contact member occurs along the planar surface 80 and not with any solder.

This configuration of the contact member advantageously provides greater control of the axial dimension between the contact member and eyelet. As described above, the tang 32 is axially spaced from the center contact 30 by a dimension 36. Therefore, it is desired that the spacing along the longitudinal axis between the contact member G and the eyelet of the lamp base be accurately controlled to substantially coincide with dimension 36. With the fixed, planar surface of the contact member defining the contact area with the tang 32, instead of the solder 48 (FIG. 4), the axial spacing can be more closely controlled with the subject invention than was possible with the prior art arrangement.

Figure 7B:
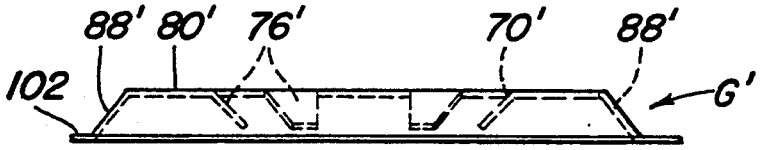
FIG. 7B is an elevational view of the contact member of FIG. 7A.
Figure 7C:
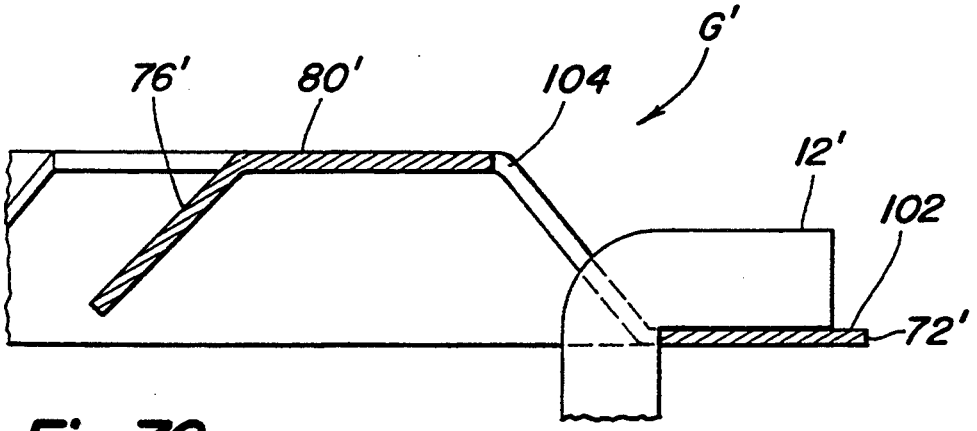
FIG. 7C is an enlarged cross-sectional view taken generally along the lines 7C–7C of FIG. 7A.

A second preferred embodiment is shown in FIGS. 7A–7C. Like numerals with a primed suffix (′) will refer to like elements while new numerals refer to new elements. The contact member G′ again includes an enlarged planar surface 80′ that extends from the inner periphery 70′ over a major or substantial portion of the entire radial width of the contact member. In this embodiment, the inner periphery 70′ has a diameter of approximately 0.360 inches and the outer periphery 72′ a diameter of approximately 0.753 inches. Additionally, the planar surface extends to a maximum diameter of approximately 0.580 inches to define a radial width of approximately 0.110 inches ((0.580–0.360)/2) of the total radial width 74′ of 0.196 inches ((0.753–0.360)/2). Thus, approximately 56% (0.110/0.196) of the total radial width is defined by the planar surface 80′.

The outer rim 102 is also slightly modified so that it extends entirely around the circumference of the contact member. Therefore, the flat 100′ that defines the orienting means for the contact member does not extend to or form a tangent with the angled wall 88′ as it does in the embodiment of FIGS. 5 and 6.

Moreover, a lead wire opening 104 is formed in the angled wall 88′ and this embodiment does not use a recess or well as described with respect to the embodiment of FIGS. 6A–6C. Nevertheless, the rim 102 is sufficient axially spaced (on the order of 0.0375 inches) from the planar surface 80′ so as to accommodate the lead wire 12′ and preclude contact with the tang 32 while simultaneously providing desired strength and rigidity to the contact member. A soldered or welded connection can still be formed between the lead wire and the contact member so that any excess solder would remain at a height below the planar surface 80'. Thus, this embodiment also provide more accurate dimensional control of the areas of contact of the contact member and eyelet with the center contact 30 and tang 32 of the socket to coincide with dimension 36 as described above.

FIG. 8 illustrates a modified eyelet 52 that includes a raised wall 110 that extends around the central opening 112 of the eyelet. This eyelet arrangement is intended to form a recess or well in which the solder resides while the raised wall presents a surface that will establish sound electrical contact with the center contact 30. Further, the raised wall has no adverse effect on the mechanical and electrical connection between the third lead wire and the eyelet.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. A lamp comprising:

an envelope formed of a light transmissive material;

an externally threaded, electrically conductive shell sealed to and extending outward along a longitudinal axis from the envelope;

a generally annular contact member located within a base connected to the shell axially spaced from the shell, the contact member having a first planar surface over a major portion thereof and a lead wire opening axially spaced from the first planar surface and disposed on a second planar surface, the contact member also having a rim in the second planar surface along its outer periphery that is spaced from the first planar surface;

an eyelet connected to said base on a side opposite the shell and axially spaced therefrom and electrically insulated from both the shell and contact member;

first and second filaments received in the envelope; and, first, second, and third lead wires respectively electrically connecting the filaments to the shell, contact member, and eyelet to provide three levels of illumination.

2. The lamp as defined in claim 1 wherein the contact member has a radial width defined between inner and outer peripheries, and the planar surface extends over substantially the entire radial width.

3. The lamp as defined in claim 1 wherein the rim is substantially circumferentially continuous.

4. The lamp as defined in claim 1 wherein the rim and lead wire opening are coplanar.

5. The lamp as defined in claim 1 wherein the contact member has a surface that orients the contact member during assembly of the lamp.

6. The lamp as defined in claim 2 wherein the planar surface extends over approximately 66% of the radial width of the contact member.

7. The lamp as defined in claim 1 wherein the rim and planar surface are interconnected by an angled wall that is non-perpendicular to both the rim and planar surface.

8. The lamp as defined in claim 1 wherein the contact member planar surface is circumferentially continuous.

9. A lamp comprising:

an envelope formed of a light transmissive material;

an externally threaded, electrically conductive shell sealed to and extending outward along a longitudinal axis from the envelope;

a generally annular contact member located within a base connected to the shell axially spaced from the shell, the contact member having a first planar surface over a major portion thereof and a lead wire opening axially spaced from the first planar surface and disposed on a second planar surface, the contact member having a rim in the second planar surface along its outer periphery wherein the rim and lead wire opening are substantially coplanar;

an eyelet connected to said base on a side opposite the shell and axially spaced therefrom and electrically insulated from both the shell and contact member;

first and second filaments received in the envelope; and first, second, and third lead wires respectively electrically connecting the filaments to the shell, contact member, and eyelet to provide three levels of illumination.

10. A lamp comprising:

an envelope formed of a light transmissive material;

an externally threaded, electrically conductive shell sealed to and extending outward along a longitudinal axis from the envelope;

a generally annular contact member located within a base connected to the shell axially spaced from the shell, the contact member having a first planar surface over a major portion thereof and a lead wire opening axially spaced from the first planar surface and disposed on a second planar surface, the contact member having a rim in the second planar surface along its outer periphery wherein the rim and the second planar surface are interconnected by an angled wall that is non-perpendicular to both the rim and the second planar surface;

an eyelet connected to said base on a side opposite the shell and axially spaced therefrom and electrically insulated from both the shell and contact member;

first and second filaments received in the envelope; and first, second, and third lead wires respectively electrically connecting the filaments to the shell, contact member, and eyelet to provide three levels of illumination.

* * * * *